US005538755A

United States Patent [19]

Martin

[11] Patent Number: 5,538,755

[45] Date of Patent: Jul. 23, 1996

[54] PROCESS FOR REHABILITATION OF SEWER COLLECTION SYSTEM STRUCTURES

[76] Inventor: Tim Martin, 135 Santa Rosa Dr., Pace, Fla. 32571

[21] Appl. No.: 134,200

[22] Filed: Oct. 12, 1993

[51] Int. Cl.[6] ..... B32B 35/00

[52] U.S. Cl. ..... 427/140; 427/230; 427/299; 427/301; 427/407.1; 427/419.3

[58] Field of Search ..... 427/140, 230, 427/419.3, 419.5, 407.1, 301, 299

[56] References Cited

U.S. PATENT DOCUMENTS

| | | | |
|---|---|---|---|
| 3,653,951 | 4/1972 | Maldeis et al. | 427/140 |
| 5,108,790 | 4/1992 | Bubock | 427/136 |
| 5,286,425 | 2/1994 | Bubock et al. | 427/136 |

*Primary Examiner*—Janyce Bell
*Attorney, Agent, or Firm*—Quarles & Brady

[57] ABSTRACT

A method for rehabilitating manholes and other sewer collection system structures begins by repairing existing leaks using hydraulic grout and cleaning the interior surface of the manhole by sandblasting or the like. A waterproofing stage is applied in multiple coats using a crystallization agent that integrates a crystalline structure with the underlying substrate. A chemical attack resistant calcium aluminate cement stage is then applied, and the waterproofing capabilities of the underlying coating are enhanced by the integration of the crystalline structure with the calcium aluminate cement stage. An epoxy coating is applied on the calcium aluminate cement to provide further chemical resistance and waterproofing while simultaneously providing a continuous, bridging barrier during self-repair of cracks in the underlying calcium aluminate by expanding crystallization by the crystallization agent.

6 Claims, 2 Drawing Sheets

PROCESS FOR REHABILITATION OF SEWER COLLECTION SYSTEM STRUCTURES

FIELD OF THE INVENTION

The invention relates to techniques for the repair and rehabilitation of sewer collection systems. More particularly, the invention relates to the repair and rehabilitation of manholes.

BACKGROUND OF THE INVENTION

Maintaining the integrity of sewer collection systems has been a significant challenge for managing municipalities and utilities since the use of such systems began. Increased demand on the systems by growing user populations as well as dilapidation due to aging and chemical corrosion continuously create leaks in the system components.

During periods of ground saturation, such as during heavy rain storms, the ground water can infiltrate the sewer collection system through these breaches. The increased water in the system adds to the flow that must be processed by the system's water treatment plant. This increased load can often exceed the capacity for the treatment plant, and create further complications and possible damage to the overall system. Additionally, breaks in the sewer lines can permit leakage of sewage from the system into the surrounding soil. This contamination is unacceptable, particularly in view of ever increasing concerns for environmental safety.

One common component of sewer collection systems that is often in need of rehabilitation is the manhole. Manholes provide human access ports from the grade or street level to open pipeline "inverts" for inspection and repair of the sewer collection system. Manholes are not only exposed to sewage flow within the system but also to run-off from above. Manholes are typically made from precast concrete, brick, tiles or concrete blocks bonded together by mortar. These construction elements can be deteriorated by chemical attack, such as by sulfuric acid microbiologically generated by the hydrogen sulfide present in the sewage. The corroded materials can break away, crack or separate, thereby creating breaches through which leakage and seepage can occur.

Many techniques for the rehabilitation of deteriorated manholes have been developed. Ruptures, particularly those causing large leaks, are patched using grouting. Hydrophilic gel is a water-activated grout solution that can fill and seal cracks and joints with a flexible mass. The gel can also be used to fill water collecting voids between the leaking manhole and the surrounding soil. The gel can further penetrate and consolidate the surrounding soil to produce a substantially water impermeable grout-soil mass or grout membrane. While grouting is effective in reducing relatively large leak flows, it is too expensive to use as a sealant for the entire manhole structure and is difficult to control because of its injection through the manhole wall to the otherwise inaccessible, outer "positive" side.

For structurally rehabilitating and chemically safeguarding an entire manhole surface area, Portland cement or calcium aluminate cement are typically used. While these materials have superior chemical resistance properties, they can crack due to ground shifts and other disturbances and permit leakage in and out of the system.

Epoxy coatings in the form of sleeve-like liners or spray or hand-applied coatings also provide resistance against attack by a variety of corrosive chemicals as well as abrasion. However, these epoxy surfaces are susceptible to rupture and peeling when hydrostatically pressured from behind by external water infiltration through cracks in the underlying manhole walls.

While the various techniques and materials for rehabilitating manholes provide advantages individually, the associated disadvantages of these techniques make them inappropriate individually as long-term solutions to establishing and maintaining manhole integrity.

SUMMARY OF THE INVENTION

It is an object of the invention to provide a process for rehabilitating manholes and other sewer collection system components.

It is another object of the invention to provide a process of manhole rehabilitating manholes that utilizes no-dig technology to avoid excavation.

It is still another object of the invention to provide a process for rehabilitating manholes that provides long term resistance against chemical attack in a sewer collection system environment.

It is yet another object of the invention to provide a process for rehabilitating manholes that provides multidirectional waterproofing against leakage both in and out of the sewer collection system.

It is a further object of the invention to provide a process for rehabilitating manhole in which the waterproofing enhances the performance of the chemical resistance components.

It is a still further object of the invention to provide a process for rehabilitating manholes in which the chemical resistance components enhance the waterproofing capabilities of the system.

It is also an object of the invention to provide a method of manhole rehabilitation that can automatically repair leak-causing cracks after rehabilitation is complete.

These and other objects of the invention are achieved by a multistage process for waterproofing, structurally restoring and chemically protecting sewer collection system components, particularly manholes. Using manholes as an example, the process preferably begins by preparing the manhole for rehabilitation by plugging and sealing leaking cracks and other ruptures, preferably using hydraulic grouts and cleaning the interior surface of the manhole of loose debris and broken material.

Next, waterproofing with a waterproofing crystallizing agent is performed. Preferably, a five-coat waterproofing procedure utilizes cementitious and silicate-based materials that are applied to the interior surface of the manhole to seal and stop leakage on the interior, "negative" side of the manhole wall from the exterior. The materials of the waterproofing coating react with moisture and the constituents of the underlying substrate of the manhole to form a crystaline structure throughout the capillary structure of the substrate. The crystalline structure become integral with the underlying structure and blocks the passage of water.

To provide chemical attack resistance and to otherwise increase the structural integrity of the rehabilitated manhole, a self-bonding cement solution, preferably a calcium aluminate, is next applied over the crystalline waterproofing stage. By applying the calcium aluminate cement to the waterproofing, crystallizing agent, the crystalline structure is able to expand into and integrate with the calcium aluminate, thereby increasing the bonding strength of the calcium aluminate to the underlying substrate and enhancing the waterproofing capabilities of the crystalline waterproofing agents in both directions. By applying these stages to the rehabilitated manhole, a multidirectional waterproofing and chemical resistance is created.

Ground shifts and other stress-causing occurrences can create cracks in the relatively brittle calcium aluminate cement liner. The crystallizing agent of the waterproofing stage can provide an automatic self-repair to these cracks by expanding into and sealing the cracks.

For further and chemical attack resistance and abrasion resistance, a flexible epoxy is preferably applied on the calcium aluminate cement layer. The epoxy coating is highly elastic and is capable of maintaining a bridging coating across any crack that may be created in the underlying calcium aluminate cement. The epoxy coating maintains a chemically resistant, water-resistant barrier during the automatic repairing of the crack in the underlying calcium aluminate liner by the expanding waterproofing crystalline structure.

Thus, the invention provides a method for providing long-term rehabilitation and maintenance of manhole integrity by providing multidirectional waterproofing and chemical attack resistance in which the various components are applied in a manner to alleviate the disadvantages associated with each individual component and enhance the advantages and benefits provided by each of the components.

BRIEF DESCRIPTION OF THE DRAWINGS

A more thorough understanding of the invention and its preferred embodiments can be gained from a reading of the following description in connection with the accompanying drawings, in which.

DETAILED DESCRIPTION OF EMBODIMENTS OF THE INVENTION

The invention is directed to a process for rehabilitating sewer collection system components, such as manholes, wet wells, lift stations and sewer pipes. The invention has primary applicability to manholes, and the description set forth herein will be directed to rehabilitating manholes with the understanding that the process can be applied to other sewer collection system structures.

Figure 1:
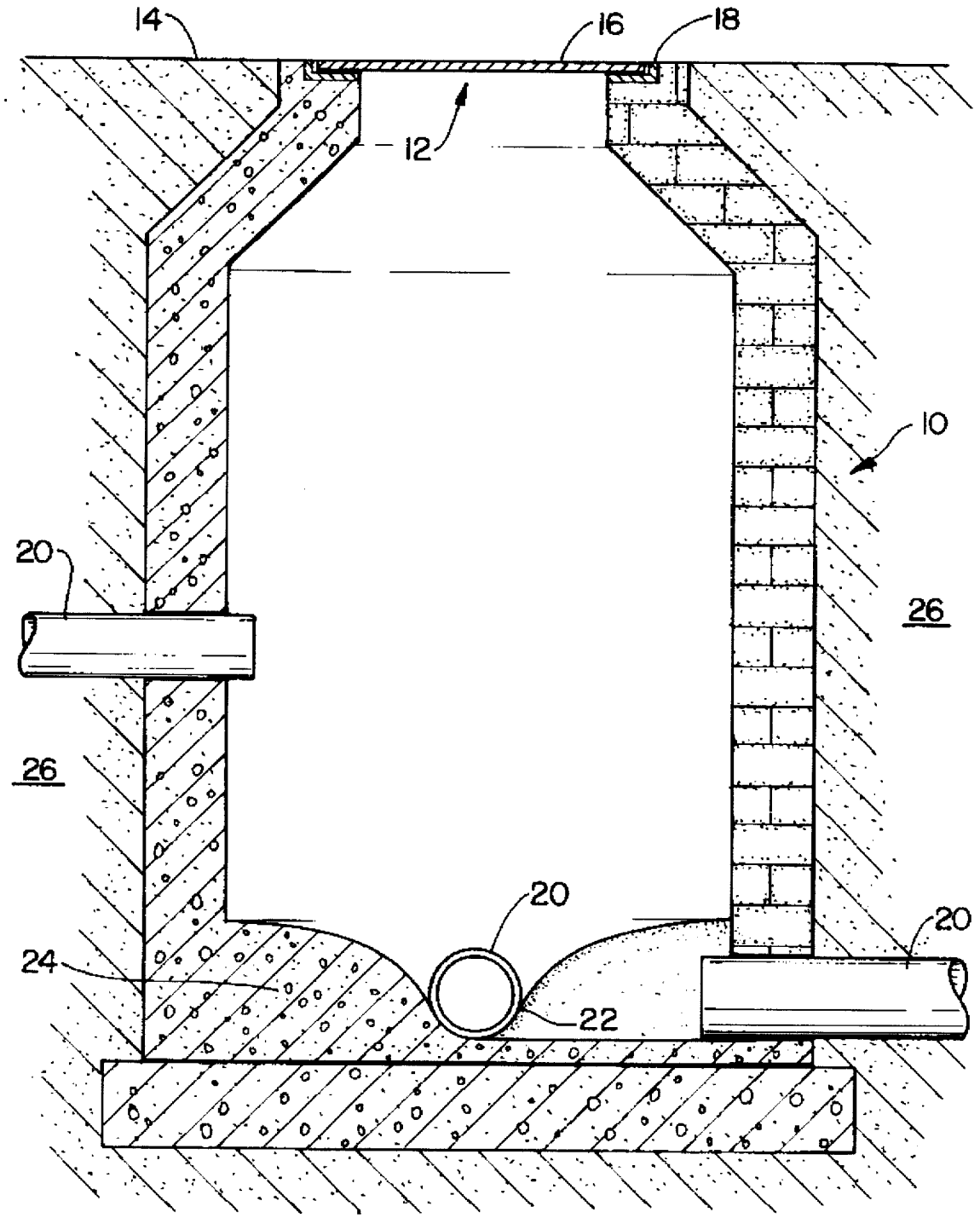
FIG. 1 is a side sectional view of a conventional manhole.

Referring generally to the accompanying drawings and particularly to FIG. 1, the process of the invention can be used to rehabilitate a manhole 10 made of brick, tile, concrete block and mortar or precast concrete. In FIG. 1, the left-hand portion of the manhole 10 is illustrated as precast concrete while the right-hand side of the manhole is illustrated as brick. The conventional manhole can include an opening 12 to the grade 14, covered by a manhole 10 cover 16 mounted on a manhole ring 18. The manhole 10 can serve as a junction for various pipes 20 in the network of the sewer collection system. One of the pipes 20 can include an invert mounted at the base 22 of the manhole next to a manhole bench 24. The structure of the manhole 10 is surrounded by supporting earth 26.

Figure 2:
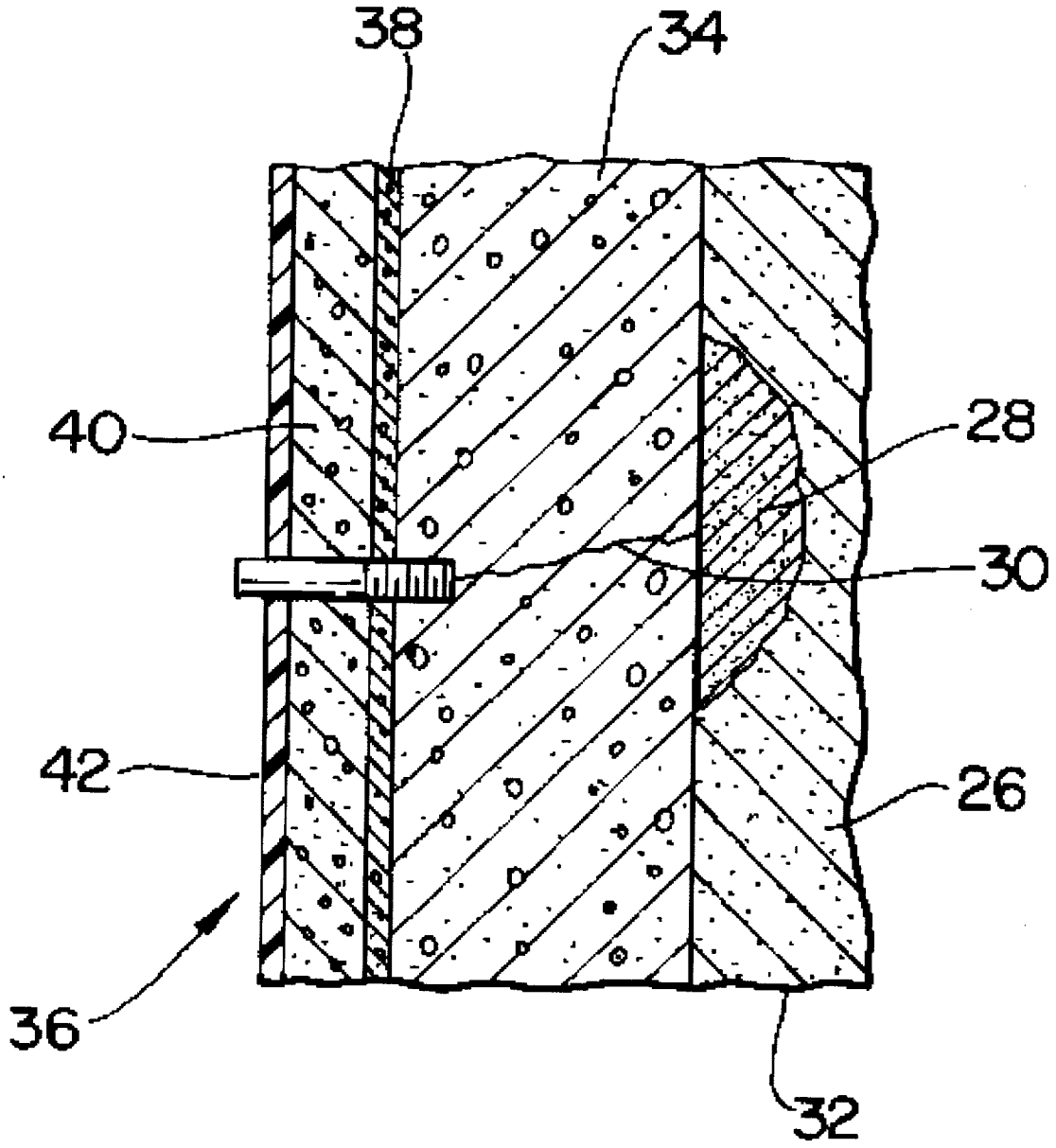
FIG. 2 is a side sectional view of a manhole side wall treated with a version of the rehabilitation process of the invention.

Referring to FIG. 2, the process includes the application in successive steps of layers or stages to waterproof, structurally restore and increase the chemical resistance of the manhole walls. First, a hydraulic grout 28 can be applied to repair leaking cracks 30 and other openings between the earth 26 on the positive side 32 of the manhole wall 34 and the interior or negative side 36 of the manhole wall 34.

Next, a crystalline waterproofing stage 38 is applied. A chemical resistant cement solution 40 is applied to the crystalline waterproofing stage 38 whereby the crystallization agent of the waterproofing stage 38, integrates a crystalline structure into the underlying substrate of the manhole wall 34 as well as into the cement solution 40. Finally, an epoxy coating 42 is preferably applied over the cement solution layer.

The process according to the invention can generally be accomplished without bypassing waste water flow in the sewer collection system. However, in some cases, the waste water flow may be plugged and contained within the capacity of the collection system if resultant surcharging is deemed harmless.

In a preferred performance of the process, the rungs or steps of the manhole are removed, the interior is cleaned and debris is removed. This preparation can include plugging lines and screening out displaced debris, applying an acid wash to clean and degrease the interior surface, hydroblasting or sandblasting the surface and finally removing the debris created by the cleaning and process. It is preferred that minor defects in the walls, benches and inverts of the manhole are repaired using repairing cement.

Depending on the size and quantity of leaks in the manhole wall structure, various hydraulic cements are preferably used to substantially seal the leaks. In the field, it is known to commonly use hydraulic grouts, including hydrophilic chemical grouts that expand in the present of water and contract in the absence of water. The hydrophilic chemical grouts expand to form a flexible mass that seals the area that is occupied from further water infiltration. Alternatively, hydrophobic gels can be used; however, due to the rigidity of the foam formed by hydrophobic gels, subsequent movement ,Dan result in leaking cracks that are not self-repaired. Generally, any hydraulic grout capable of forming an expansive foam in the presence of water can be used. Hydrophilic grout is preferably injected adjacent smaller leaks as needed to eliminate infiltration by sealing the negative side of the manhole wall next to the earth. An expansive hydrophilic foam grout can be used to stop major intrusion of water and fill cracks and voids behind the manhole wall surface.

A preferred expansive foam grout has the following properties:

| | | |
|---|---|---|
| Tensile Strength | 380 psi | ASTM D 3574-86 |
| Elongation | 400% | ASTM D 3574-86 |
| Bonding Strength | 250–300 psi | |

An expansive foam grout having these properties is HA Sealfoam, manufactured by de neef Construction Chemicals, Inc., Waller, Tex. 77484.

A hydrophilic gel grout can be used for soil stabilization on the positive side of the manhole wall to prevent seepage, to provide a damming effect and to place a hydrostatic barrier around the exterior of the manhole. Preferred physical properties of this growth are as follows:

| | | |
|---|---|---|
| Density | 8.75–9.17 lbs./gal. | ASTM D-3574 |
| Tensile Strength | 150 psi | ASTM D-412 |
| Elongation | 250% | ASTM D-3574 |
| Shrinkage | Less than 4% | ASTM D-1042 |
| Toxicity | Non-toxic | |

A hydrophilic gel grout having these properties is HA Flex LV, manufactured by de neef Construction Chemicals, Inc., Waller, Tex. 77484.

For larger leaks, a quick-setting hydraulic cement compound can be used to plug all visible leaks and to stop major leaks so that further waterproofing processes can proceed unhindered. The repairing cement is preferably non-shrinking, non-metallic and non-corrosive. The preferred compound has the following properties:

| | |
|---|---|
| Set Time | 1–3 minutes |
| Tensile Strength | 1 day - 510 psi |
| ASTM-C-307 | 3 days - 745 psi |
| | 28 days - 855 psi |
| Compressive Strength | 1 day - 3,125 psi |
| ASTM-C-109 | 7 days - 7,808 psi |
| | 28 days - 9,543 psi |
| Flexural Strength | 1 day - 410 psi |
| ASTM-C-78 | 3 days - 855 psi |
| | 28 days - 1,245 psi |

A preferred hydraulic cement having these properties is Dura Plug, manufactured by Tamms Industries, a division of LaPorte Construction Chemicals North America, Inc., Mentor, Ohio, 44060.

Alternative hydraulic cements and other cementitious materials that are fast setting in the range of 1 to 3 minutes or less and have a controlled amount of expansion in the range of less than 5% can also be used in the process.

After the manhole interior has been prepared by cleaning and sealing of leaks and seepage, the waterproofing stage is applied, using a waterproofing component having a crystallization agent. The waterproofing component preferably combines cementitious and silicate-based materials to seal and stop leakage caused by hydrostatic pressure on the negative side of the manhole. A combination of five coats is preferably applied to react with moisture and the constituents of the substrate to form a crystalline structure in the substrate. Preferred physical properties of the waterproofing component are:

| | |
|---|---|
| Slant/Shear Bond Strength to Calcium Aluminate Cement ASTM (to be given) | 1,200–1,800 psi |
| Tensile Strength (7 day cure) | 380 psi (2.62 MPa) at 100% RH<br>325 psi (2.24 MPa) at 50% RH |
| Permeability (3 day cure) | $8.1 \times 10^{-10}$ cm/sec to<br>$7.6 \times 10^{-11}$ cm/sec. |

The crystallization agent includes a silicate-based product, either a calcium silicate or a sodium silicate. A calcium silicate-based product, such as the Hey'di Special System is preferred. The Hey'di Special System is manufactured by Tamms Industries, a division of LaPorte Construction Chemicals, North America, Inc.,Mentor, Ohio 44060. The calcium silicate product, when applied to masonry, including stone, brick mortar, concrete and other cements in the presence of moisture, generates crystals that expand into the capillary structure of the porous substrate. Other crystallization agents which can be used with the process include sodium silicate-based materials. However, these materials typically require water curing for approximately seven days and are difficult to handle because of their caustic nature.

The preferred Hey'di Special System includes a first component, designated by the manufacturer as Powder #1. This Powder #1 is mixed in a slurry and brushed on the interior of the manhole surface to entirely waterproof the negative side of the manhole wall from water intrusion from the exterior.

In areas of the manhole interior in which the water has saturated the manhole water, the leak is too excessive to allow Powder #1 to set. Accordingly, a second component, designated by the manufacture as Powder X, is applied in the form a dry powder. The presence of the Powder #1 throughout the rest of the manhole interior prevents the migration of the water saturation from the original location, which is sealed by Powder X, to new locations. According to one aspect of the invention, the Powder X is applied to the entire surface of the manhole interior to provide a secondary backup to the waterproofing functions of Powder #1.

The calcium silicate cementitious material more rapidly performs the crystallization process as the quantity of water present increases. To expedite the crystallization process into the underlying substrate, the manufacture provides the calcium silicate waterproofing crystallizing agent in the form of a sealing liquid. The sealing liquid drives the crystallization agent into the underlying substrate and promotes rapid crystallization. Additionally, the sealing liquid provides over coating over the dry Powder X, thereby providing an adequately moist substrate for the cement liner to be applied on top of the waterproofing stage.

To provide corrosion and chemical attack resistance, primarily against hydrogen sulfide-based corrosion, a cement solution is applied over the waterproofing stage. The cement solution is preferably a self-bonding calcium aluminate cement having the following properties:

Technical Data

| 2000 H S Regular | | 12 hrs | 24 hrs | 7 days | 28 days |
|---|---|---|---|---|---|
| ASTM C2195 | Compressive Strength (psi) | 7000 | 11000 | 12000 | 13000 |
| ASTM C293 | Flexural Strength (psi) | 1000 | 1500 | 1800 | 2000 |
| ASTM C596 | Shrinkage @ 90% Humidity | — | <0.04 | <0.06 | <0.08 |
| ASTM C666 | Freeze Thaw After 300 Cycles | No Damage | | | |
| ASTM C900 | Pull Out Strength | 200–230 psi Tensile Str. | | | |
| ASTM C457 | Air Void Content 7 Days | 3% | | | |
| ASTM C497 | Porosity/Absorption Test 7 days | 4–5% | | | |

Modules of elasticity: $7.10 \times 10^6$ psi after 24 hrs. moist curing at 68° F.

A calcium aluminate cement having these characteristics is Sewpercoat, manufactured by Lafarge Calcium Aluminates, Chesapeake, Va. 23324.

The calcium aluminate cement is preferably reinforced with inert fibers that comply with ASTMC-116 and ASTMC-1018, added at the rate of 1 lb. per cubic yard of concrete. The mixture is preferably applied to a thickness of at least ½ inch but no greater than 2 inches.

The cement liner provides chemical resistance primarily against hydrogen sulfide-based attack and also provides structural integrity to the manhole, which may be in a state of structural dilapidation prior to its restoration. This structural integrity is further enhanced by the increase bonding strength of the cement liner provided by the expansion of the crystallization into the calcium aluminate liner.

The cement liner can alternatively comprise a Portland cement. Alternatively, the cement liner can comprise a combination of calcium aluminate and Portland cement materials. However, a high concentration calcium aluminate cement as manufactured by Lafarge is preferred.

To further increase the abrasion resistance and chemical resistance of the manhole wall, a high build, flexible waterproofing epoxy is preferably applied. In the event that the underlying cement solution layer cracks, the highly elastic epoxy can maintain a sealing bridging barrier to prevent chemical and water intrusion to the crack while the underlying crystallization agent expands the crystalline structure to automatically repair the crack. The epoxy is preferably 100 percent solids, although epoxies of less purity car, be used. The epoxy preferably has the following properties:

| (Epoxy Properties at 75° F.) | |
|---|---|
| Pot Life, hrs | 1 |
| Tensile Strength, psi, min. | 2,000 |
| Tensile Elongation, % | 10–20 |
| Water Extractable Substances, mg./sq.in., max. | 5 |
| Bond Strength To Cement (ASTM 882) psi | 1,800 |

An epoxy having these properties is Duralkote manufactured by Tamms Industries, a division of LaPorte Construction Chemicals North America, Inc., Mentor, Ohio 44060. This epoxy has been shown to have chemical resistance to: alcohols; 3% nitric acid; 3%–10% sulphuric acid; 3% lactic acid; 3% hydrochloric acid; sodium chloride; methyl-ethyl-ketones; jet fuels; and butyl acetate.

Alternatively, urethane coatings to provide abrasion resistance and chemical resistance can be used to coat the cement liner according to the process. However, urethane-based coatings are not preferred because they typically must be applied in labor-intensive multiple coats and are more sensitive to moisture.

In a preferred performance of the process according to the invention, the interior surface of the manhole is prepared for the process by an acid wash to clean and degrease the surface. Optionally, the rungs can be removed from the manhole, and the entire exterior structure should be thoroughly water and/or sandblasted to remove any loose or deteriorated material.

The hydraulic grout is hand-placed or spray-applied to fill smaller cracks and voids in the structure. After approximately twenty minutes, the waterproofing/crystallization process can begin.

To repair larger holes, hydrophilic gel and foam can be pressure injected. ⅝ inch holes are preferably drilled through active leaking surfaces, and zert fittings are inserted as recommended by the manufacturer, de neef. The hydrophilic gel or hydrophilic foam is injected until the water flow stops, and the fittings are removed.

In the waterproofing/crystallization stage, a slurry coat of Powder #1 is preferably applied to a moist wall using a stiff brush to form an undercoat. The Powder X can be preferably applied by hand to the slurry coat, and then the Sealing Liquid is brush or spray-applied to penetrate and initiate the crystal forming process. The application of Powder X and the Sealing Liquid can be repeated until there are no visible leaks. Finally, Powder #1 is preferably applied as an overcoat.

To apply the cement lining, the surface of the underlying waterproofing stage is dampened. The preferred calcium aluminate cement is either spray or hand-applied to a build-up of at least one-half inch, but no more than two inches. The calcium aluminate stage is then trowelled to a smooth finish and textured brushed to prepare for the epoxy finish.

The epoxy coating is preferably sprayed applied to at least 30 mils thickness.

The debris created during the process is then cleared and the work area is cleaned.

Although the description of the invention has been given with reference to particular embodiments, this description is not to be construed as limiting the scope of the invention. Many variations and modifications may now occur to those skilled in the art in view of this disclosure. Accordingly, the scope of the present invention should not be determined by the above description, but rather by a reasonable interpretation of the appended claims.

I claim:

1. A process for rehabilitating a sewer collection system component to provide multidirectional waterproofing and resistance against chemical attack and to provide automatic self-repair of cracking, said process comprising the steps of:

applying a waterproofing layer on an interior side of a wall of the component using waterproofing materials including a silicate-based crystallization agent;

applying a layer of cement on said waterproofing layer, said silicate-based crystallization agent forming a waterproofing crystalline structure between said layer of cement and the wall, whereby the waterproofing crystallization agent advances the crystalline structure into the cement layer and the wall, thereby increasing the waterproofing capabilities of the waterproofing layer and increasing the bonding strength of the cement, said cement being chemically resistant to at least sulfuric acid; and applying an epoxy layer on said cement layer, whereby said epoxy layer provides a chemical attack resistant, waterproofing barrier that can bridge cracks in the layer of chemical attack resistant cement while the crystallization agent expands the crystalline structure to fill said cracks.

2. The process according to claim 2, wherein the silicate is a calcium silicate.

3. The process according to claim 1, wherein the silicate is a sodium silicate.

4. A process for rehabilitating a sewer collection system component to provide multidirectional waterproofing and resistance against chemical attack and to provide automatic self-repair of cracking, said process comprising the steps of:

patching leaks in the component wall by injecting a hydraulic grout to the exterior of the component and plugging the leaks with hydraulic grout;

applying a waterproofing layer on an interior side of a wall of the component using waterproofing materials including a silicate-based crystallization agent; and applying a layer of cement on said waterproofing layer, said silicate-based crystallization agent forming a waterproofing crystalline structure between said layer of cement and the wall, whereby the waterproofing crystallization agent advances the crystalline structure into the cement and the wall, thereby increasing the waterproofing capabilities of the waterproofing layer and increasing the bonding strength of the cement, said cement layer being chemically resistant to at least sulfuric acid.

5. The process according to claim 4, wherein said epoxy is 100% solids.

6. A process for rehabilitating a sewer collection system component to provide multidirectional waterproofing and resistance against chemical attack and to provide automatic self-repair of cracking, said process comprising the steps of:

applying a waterproofing layer on an interior side of a wall of the component using waterproofing materials including a silicate-based crystallization agent;

applying a layer of cement on said waterproofing stage, said silicate-based crystallization agent forming a waterproofing crystalline structure between said layer of cement and the wall, whereby the waterproofing crystallization agent advances the crystalline structure into the cement and the wall, thereby increasing the waterproofing capabilities of the waterproofing layer and increasing the bonding strength of the cement layer, said cement layer being chemically resistant to at least sulfuric acid, wherein applying the waterproofing stage includes the sub-steps of:

applying a slurry of the waterproofing material including the silicate-based waterproofing crystallization agent to substantially the entire interior side of said;

applying a dry powder including the silicate-based waterproofing crystallization agent over substantially the entire surface of said slurry;

applying a sealing liquid including the silicate-based waterproofing crystallization agent on said dry powder.

* * * * *